United States Patent [19]

Brammer et al.

[11] 4,185,600

[45] Jan. 29, 1980

[54] REPLACEMENT UNIT FOR CONTACTLESS IGNITION CONTROL IN INTERNAL COMBUSTION ENGINES

[75] Inventors: Hartmut Brammer, Schwieberdingen; Helmut Jooss, Ditzingen; Harry Kaiser, Hochdorf; Gerhard Schellenberg, Fellbach, all of Fed. Rep. of Germany

[73] Assignee: Robert Bosch GmbH, Stuttgart, Fed. Rep. of Germany

[21] Appl. No.: 890,195

[22] Filed: Mar. 27, 1978

[30] Foreign Application Priority Data

Apr. 14, 1977 [GB] United Kingdom ..... 2716510

[51] Int. Cl.[2] ..... F02P 1/00

[52] U.S. Cl. ..... 123/146.5 A; 200/19 M

[58] Field of Search ..... 123/148 E, 146.5 A, 123/148 CB; 200/19 M, 19 R

[56] References Cited

U.S. PATENT DOCUMENTS

| | | | |
|---|---|---|---|
| 3,976,044 | 8/1976 | Madeira | 123/148 E |
| 3,989,023 | 11/1976 | Florio | 123/148 E |
| 4,000,724 | 1/1977 | Fowler | 123/148 E |
| 4,008,701 | 2/1977 | Webber | 123/148 E |
| 4,109,630 | 8/1978 | Richeson | 123/148 E |

*Primary Examiner*—Ronald B. Cox

*Attorney, Agent, or Firm*—Frishauf, Holtz, Goodman & Woodward

[57] ABSTRACT

The replacement unit includes a magnet circuit support magnetic barrier member which includes the magnet unit of a Hall generator and is adapted to be fastened to the contact interrupter plate. The unit also includes a distributor rotor adapted for mounting on the contact interrupter cam of the distributor shaft. A plastic reinforcing member of higher mechanical strength is anchored in the distributor rotor. It has a keying projection and extends over the region surrounding said projection, thereby reinforcing the critical section of the distributor rotor. Preferably it is cap-shaped and has an opening for accommodating a retaining member which retains the distributor rotor in the desired position.

18 Claims, 3 Drawing Figures

REPLACEMENT UNIT FOR CONTACTLESS IGNITION CONTROL IN INTERNAL COMBUSTION ENGINES

The present invention relates to replacement units for the distributor of an internal combustion engine. In particular it relates to such replacement units, wherein a contactless ignition control replaces a previous ignition control utilizing contacts. It should be possible to use such replacement units for many different types of distributors. Thus, a number of different criteria, as for example the direction of rotation of the distributor rotor, and the direction of the force applied by the vacuum box must be taken into consideration. Further, only simple tools should be required to effect the change or replacement.

The replacement unit has a reinforcing member of higher mechanical strength anchored in a distributor rotor adapted for mounting on the interruptor cam of the distributor shaft. The reinforcement member has a keying projection and extends over the region surrounding said projection. Any deformation of the distributor rotor by action of the shaft is thus prevented, so that the ignition characteristics remain the same throughout the operating life.

If the member is made in a cap-shaped form and has a bore for accommodating a retaining member which retains the distributor rotor in the desired position relative to the shaft, the critical cross section of the distributor rotor is strengthened, while an economical manufacture of the part is possible.

In accordance with a preferred embodiment of the invention, the reinforcing member is made of a thermosetting resin, preferably polyamide, which is of improved strength with respect to standard distributor rotors, due to increased rotor mass and thereby avoids ignition timing drift. In order to effect the necessary ground connection between the distributor rotor and the distributor shaft or the interruptor cam, an S-shaped contact spring is provided. Further, in a preferred embodiment a magnet unit support is provided, made of insulating material. A plate projects from each end section of the support such that control wires which are arranged underneath do not enter the region of the rotor, thereby assuring reliable operation even when the replacement is not installed exactly according to the instructions.

In order that the control lines or wires from the magnet unit of the pulse generator also extend to the other sie of the support, a channel is provided on the underside thereof. In a preferred embodiment at least one of the plates is provided with clamps for clamping each of the control lines so that they are positioned at fixed distances relative to each other and also are not subject to excessive stress.

In a preferred embodiment, the part of the control lines that is within the distributor is thin and highly flexible, while the portion outside of the distributor is of higher mechanical strength. The connection between the two portions of each control line is made by a shaped plastic member arranged in a through hole in the distributor housing. In order to fix the position of this member reliably and simply relative to the housing, a strap is provided which has a forked portion offset in an outward direction. The forked position engages two slots in the member. When the strap is screwed on, it pushes the part radially outward so that the flange formed by the slots is pressed against the inner wall of the distributor housing.

DRAWING ILLUSTRATING A PREFERRED EMBODIMENT

Figure 1:
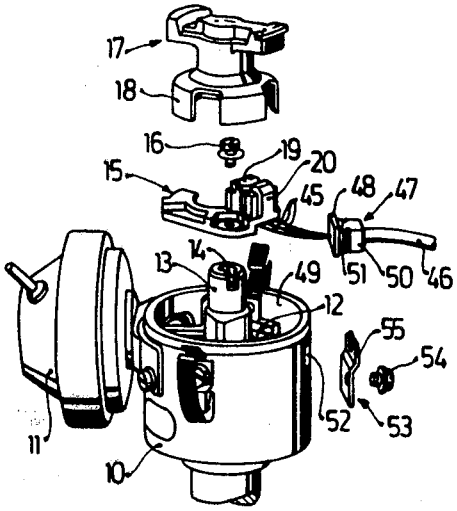
FIG. 1 is an exploded view in a reduced scale of the distributor housing, the magnetic barrier with the shaped part and the distributor rotor assembly.

In FIG. 1 a distributor housing 10 has a flange-mounted vacuum chamber 11, a pivotable interruptor plate 12, and an interruptor cam 13 mounted on a distributor shaft which is not visible in FIG. 1. The sleeve-shaped terminal of interruptor cam 13 has a radial slot 14.

The replacement unit to provide contactless ignition control comprises, in the main, magnet unit support member 15 which can be mounted on interruptor plate 12 by means of a screw 16, and a distributor rotor 17 made of plastic, for example a polyester, which has a slotted, skirt shaped rotor element 18 anchored therein.

The support member 15 is an injection molded plastic part and carries a magnet unit 19, as well as an integrated circuit unit 20 including a Hall element located radially opposite magnetic unit 19 and at a predetermined distance therefrom. Magnetic unit 19, circuit 20 and rotor element 18 form a known Hall transducer, in which the rotor element 18 cylically changes the magnetic flux from the magnetic unit 19 to the Hall element in circuit 20.

Figure 2:
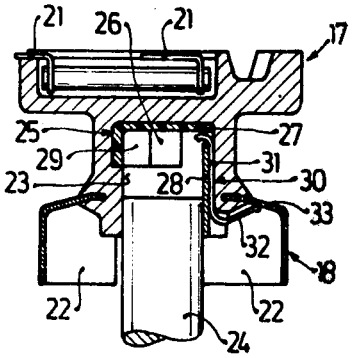
FIG. 2 is an axial section of the rotor assembly with a section of the distributor rotor in a 1:1 scale.

FIG. 2 shows a polyester distributor rotor 17 manufactured by injection molding and having two high voltage electrodes 21 and an injection molded rotor element 18 made of nonmagnetic material. Rotor element 18 has four depending flange portions or teeth 22 the number, corresponding to the number of cylinders in the engine. A plastic member 25 in inserted in a bore 23 which is adapted to be mounted on the distributor shaft 24. The plastic member 25 is of higher strength than rotor 18 and, in a preferred embodiment, is made of polyamide. This reinforcing member 25 consists mainly of a cap-shaped section having a top plate 27, and a sleeve 29 formed with an opening to receive a retaining member 28. In operation, a projection 26 extends into slot 14 (FIG. 1) of interruptor cam 13, so that this cam and hence the distributor shaft 24 is enveloped conformingly by reinforcing member 25, connection being made by projection 26. Top plate 27, projection 26 and sleeve 29 are inserted in rotor 17 as a single unit.

A contact spring 30, S-shaped in cross section, is located behind retaining member 28 and has a top part 31 abutting against the frontal face of shaft 24 and a lower part 32 abutting the skirt 33 of rotor 18. A good ground connection for the skirt 18 is thereby established.

Figure 3:
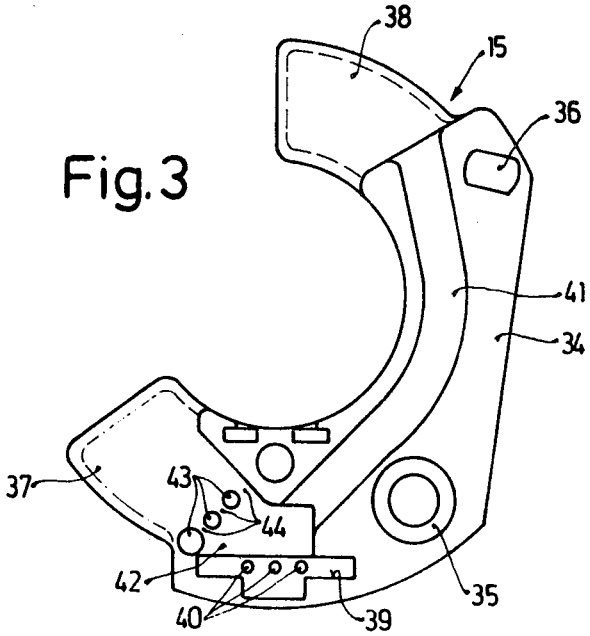
FIG. 3 an enlarged view of the underside of the magnetic barrier member.

As shown in FIG. 3, the underside of support member 15, which is also made of insulating material, comprises a base 34 which is a place of substantially semicircular shape. Base 34 has a socket 35 and a plug 36 for fastening the base onto interruptor plate 12 (FIG. 1) by means of a screw 16. Plug 36 engages a recess, which is not shown, within the interruptor plate, so that the position of support member 15 relative to interruptor plate 12 is fixed. Plates 37, 38 extend from the end sections of base 34. Each plate has an axially directed recess on the surface opposite the surface abutting against interruptor plate 12. A blind recess 39 extends from the underside into the base 34 and has three holes 40 which lead to the magnet unit on the other side of the base plate.

A channel 41, substantially rectangular in cross section, is located on the underside of base 34 and extends from a region 42 to plate 38. Three pegs 43 define three clamping terminals in conjunction with the spaces (44) adjoining the pegs.

As also shown in FIG. 1, three control lines extend from unit 20 of support member 15. The sections 45 of the control lines which are positioned within distributor housing 10 are thin and highly flexible, while the sections outside of distributor housing 10 which are formed into a cable 46 have a much higher mechanical strength. The connection between the two sections 45, 46 of each control line is made within a shaped body 47 which is made of plastic and which has a flange 48 abutting the inner surface 49 of distributor housing 10. A portion 50 of member 47 has two lateral grooves 41. A through hole 52 in distributor housing 10 receives portion 50 of the shaped body 47. A strap 53 is fastened to the outside of distributor housing 10 by means of a screw 54 and has a forked portion 55 which is offset in an outward direction. Strap 53 retains shaped body 47 in its operating position and presses flange 48 tightly against the inner side 49 of distributor housing 10.

Various changes and modifications may be made within the scope of the inventive concept.

We claim:

1. In a contactless ignition control replacement unit for the distributor of an internal combustion engine having a distributor shaft (24) formed with a keying recess (14), said replacement unit including a support member (15) adapted to be secured in said distributor, and a distributor rotor means (17) adapted for assembly to the distributor shaft (24) including a rotor element (18) variably affecting the magnetic flux between said magnetic unit (19) and a Hall generator as the rotor means (17) rotates, said rotor means being formed with a recess to receive the distributor shaft (24) therein;

a high strength cap-shape reinforcing member (25) anchored in said recess of the distributor rotor means, said member having a keying projection (26) fitting into the keying recess (14) of the distributor shaft, and a sleeve (29) extending over the region surrounding said keying projection (26).

2. In a contactless ignition control replacement unit for the distributor of an internal combustion engine having a distributor shaft (24), said replacement unit including a support member (15) adapted to be secured in said distributor, a magnetic transducer means having a magnetic unit (19) and a Hall generator mounted in magnetically coupled relation to the magnetic unit, and a distributor rotor means (17) adapted for assembly to the distributor shaft (24) including a rotor element (18) variably affecting the magnetic flux between said magnetic unit (19) and the Hall generator as the rotor means rotates, said rotor element (18) comprising a skirt portion radially spaced from the distributor shaft and having axially extending projections, and said support member (15) comprising a part-circular plate-like element having first and second plate-like end sections (37, 38), extending from the end portions of the support member (15), the support member being formed with recess means (40) located at the side obverse with respect to the side facing the depending skirt portion of the rotor elements, said recess extending between said plate sections;

and electrical control lines located in at least portions of said recess, said plate-like sections (37, 38) and said support member protecting the electrical control line with respect to inadvertent contact with the skirt portion of the rotor element.

3. Apparatus as set forth in claim 1, further comprising retaining means (28) for retaining said distributor rotor means in the operating position.

4. Apparatus as set forth in claim 1, wherein said reinforcing member (25) is a plastic member.

5. Apparatus as set forth in claim 1, wherein said reinforcing member is made of polyamide.

6. Apparatus as set forth in claim 1, further comprising means (30) for furnishing a ground connection for said rotor.

7. Apparatus as set forth in claim 6, wherein said means for furnishing a ground connection comprises an S-shaped contact spring (30).

8. Apparatus as set forth in claim 1, wherein said support member (15) is made of insulating material.

9. Apparatus as set forth in claim 8, wherein said support member (15) has first and second end section;

further comprising a plurality of electrical control lines connected to said transducer means, and a first and second end plate (37, 38) extending from said first and said second end section;

wherein said electrical control lines are arranged underneath said support member;

and wherein said end plates extend for at least a predetermined minimum distance required to space said electrical control lines away from said rotor.

10. Apparatus as set forth in claim 9, wherein said support member further has a channel (40) located on the lower side thereof and extending from said first to said second plate.

11. Apparatus as set forth in claim 10, further comprising a plurality of clamping terminals (43, 44) on the underside of at least one of said plates, for clamping said electrical control lines.

12. Apparatus as set forth in claim 11, wherein said distributor means comprises a distributor housing (10) having a through-opening (52);

wherein said control lines each have a first flexible section within said housing and a second more rigid section outside of said housing;

further comprising a plastic shaped member (47) adapted to be plugged into said through-opening and forming the connection between said first and second sections of said electrical control lines.

13. Apparatus as set forth in claim 12, further comprising strap means (53) adapted to be connected to said distributor housing (10), for maintaining said shaped member in its operating position.

14. Apparatus as set forth in claim 13, wherein said plastic shaped member (47) has a flange (48) abutting against the inner surface of said housing, said plastic shaped member further having two lateral grooves (51).

15. Apparatus as set forth in claim 14, strap means (53) having a forked portion (55) offset in an outward direction, for engaging said lateral grooves of said plastic shaped member.

16. Apparatus as set forth in claim 2, wherein said distributor means comprises a distributor housing (10) having a through-opening (52);

wherein said control lines each have a first flexible section within said housing and a second more rigid section outside of said housing;

further comprising a plastic shaped member (47) adapted to be plugged into said through-opening and forming the connection between said first and second sections of said electrical control lines.

17. Apparatus as set forth in claim 16, further including resilient clamping means engaging said plastic shaped member and resiliently biasing the plastic shaped member against the portion of the distributor housing (10) adjacent the through-opening to seal the plastic shaped member, and hence the connection lines with respect to said housing.

18. Apparatus as set forth in claim 16, wherein the rotor means (17) is formed with a recess to receive the distributor shaft (24) therein;

and a high strength cap-shape reinforcing plastic member (25) is provided, anchored in the recess of the distributor means and being formed with a keying projection (26) fitting into a keying recess (14) of the distributor shaft, and being further formed with a sleeve (29) extending over the region surrounding said keying projection.

* * * * *